US005710359A

United States Patent [19]

Lercher et al.

[11] Patent Number: 5,710,359

[45] Date of Patent: Jan. 20, 1998

[54] ENVIRONMENTALLY APPROPRIATE DEGRADATION AND DISPOSAL OF HETEROATOM-CONTAINING COMPOUNDS

[75] Inventors: Johannes Lercher, Vienna, Austria; Zhan Zhaoqui, Enschede, Netherlands

[73] Assignee: DSM Chemie Linz GmbH, Linz, Austria

[21] Appl. No.: 571,697

[22] Filed: Dec. 13, 1995

Related U.S. Application Data

[63] Continuation of Ser. No. 302,338, Sep. 8, 1994, abandoned.

[30] Foreign Application Priority Data

Sep. 9, 1993 [AT] Austria ..... 1819/93

[51] Int. Cl.[6] ..... A62D 3/00

[52] U.S. Cl. ..... 588/208; 588/213; 588/239

[58] Field of Search ..... 588/206, 207, 588/208, 209, 213, 228, 239; 208/229, 230, 2; 423/245.3

[56] References Cited

U.S. PATENT DOCUMENTS

| | | | |
|---|---|---|---|
| 4,013,757 | 3/1977 | Berkowitz et al. | 588/208 |
| 4,360,504 | 11/1982 | Blanck et al. | 423/236 |
| 4,415,658 | 11/1983 | Cook et al. | 588/205 |
| 5,009,872 | 4/1991 | Chuang et al. | 423/245.3 |
| 5,232,484 | 8/1993 | Pignatello | 588/207 |
| 5,283,041 | 2/1994 | Nguyen et al. | 423/240 |
| 5,350,849 | 9/1994 | van de Moesdijk et al. | 544/203 |
| 5,386,079 | 1/1995 | Munson et al. | 588/205 |

FOREIGN PATENT DOCUMENTS

| | | |
|---|---|---|
| 0051156 | 10/1981 | European Pat. Off. . |
| 106419 | 5/1991 | Japan . |

*Primary Examiner*—Gary P. Straub

*Attorney, Agent, or Firm*—Wenderoth, Lind & Ponack

[57] ABSTRACT

Process for the environmentally appropriate degradation of chemical compounds which have one or more heteroatoms X, with X being F, Cl, Br, I, N, O or S, by cleavage of the C—X carbon-heteroatom bonds, characterized in that the chemical compounds or articles which contain the chemical compounds are treated with water vapor in the presence of an aluminum catalyst at 300°–600° C.

16 Claims, No Drawings

ENVIRONMENTALLY APPROPRIATE DEGRADATION AND DISPOSAL OF HETEROATOM-CONTAINING COMPOUNDS

This application is a continuation of now abandoned application, Ser. No. 08/302,338, filed Sep. 8, 1994.

Heteroatom-containing compounds, such as halogenated hydrocarbons or heterocycles, for example triazine compounds, are used in many fields. Thus, for example, halogenated hydrocarbons are used as solvents, as propellants, for cleaning or as flame retardants. Other fields of application for heteroatom-containing compounds are, for example, the plastics industry or agriculture. Thus, inter alia, triazine compounds such as melamine and its downstream products, for instance melamine-formaldehyde resins, are processed on a large scale to give plastic articles or for coating wood fiber boards.

Since these compounds or articles, or formulations containing these compounds, have to be disposed of again one day, their environmentally appropriate disposal is of great importance.

Although it is known that the pyrolyric treatment of many heteroatom-containing compounds results in the formation of poisons such as hydrocyanic acid, cyanogen or isocyanic acid, no environmentally appropriate disposal process has been found hitherto.

EP-A-0 051 156 describes that traces of melamine can be removed to an extent of about 90% from waste gases in the presence of water vapor and catalysts containing copper and/or iron oxide at from 205° to 280° C.; in the presence of aluminum catalysts the extent of removal is from about 30 to at most 70%. An environmentally appropriate and as complete as possible disposal of a multiplicity of heteroatom-containing compounds, in particular of triazine compounds, is however not possible according to EP-A-0 051 156.

It is an object of the present invention to find a process which ensures very environmentally appropriate and complete disposal for a multiplicity of different compounds having carbon-heteroatom bonds.

It has now unexpectedly been found that a great variety of compounds having carbon-heteroatom bonds, such as halogenated hydrocarbons or heterocycles, in particular triazine compounds, can be degraded in an environmentally appropriate manner if they are treated with water vapor at temperatures of from 300° to 600° C. in the presence of an aluminum catalyst. This invention makes it possible to completely and environmentally appropriately degrade triazine wastes in particular.

The present invention accordingly provides a process for the environmentally appropriate degradation of chemical compounds which have one or more heteroatoms X, with X being F, Cl, Br, I, N, O or S, by cleavage of the C—X carbon-heteroatom bonds, which process is characterized in that the chemical compounds or articles which contain the chemical compounds are treated with water vapor in the presence of an aluminum catalyst at 300°–600° C.

According to the process of the invention, C—X carbon-heteroatom bonds of chemical compounds containing one or more heteroatoms X are cleaved. X is here F, Cl, Br, I, N, O or S.

For the purposes of the present invention, C—X carbon-heteroatom bonds are bonds of the group C—F, C—Cl, C—Br, C—I, C—$NH_2$, C—$NHR_1$, C—$NR_1R_2$, C—NH—C, C—$NR_1$—C, C=N—C, C—SH, C—S—C, C—S—S—C, C=S, C—O—C, C—$OR_3$, $COOR_3$ or C=O. $R_1$, $R_2$ can be identical or different and are an alkyl radical, preferably having 1–10 carbon atoms. $R_3$ can be H or an alkyl radical having 1–10 carbon atoms. Suitable chemical compounds are therefore compounds containing one or more of the abovementioned C—X bonds. These are, for example, aliphatic compounds substituted by one or more radicals of the group —F, —Cl, —Br, —I, —$NH_2$, —$NHR_1$, —$NR_1R_2$, —SH, =S, —$OR_3$, =O, —$OOR_3$. Aliphatic compounds are here saturated, singly or multiply unsaturated, linear, branched or cyclic hydrocarbons such as alkanes, alkenes, alkynes, cycloalkanes, cycloalkenes, cycloalkynes. The hydrocarbons also include hydrocarbons which, if desired in combination with the abovementioned substituents, contain in the hydrocarbon chain C—X bonds of the group C—NH—C, C—$NR_1$—C, C=N—C, C—S—C, C—S—S—C, C—O—C. The compounds can, in addition to the substituents already mentioned, contain further substituents such as a phenyl radical.

Examples of these are inter alia trichloromethane, methylene chloride, dichloroethane, butyl iodide, dimethylmethane, butyl chloride, chlorocyclohexane, bromoundecane, benzyl chloride.

The chemical compounds which can be used in the process of the invention also include aromatic compounds which are substituted by one or more radicals of the group F, Cl, B, I, $NH_2$, $NR_1$, $NR_1R_2$, $OR_3$ or SH. Aromatic compounds are here aromatic hydrocarbon rings preferably having 5–14 carbon atoms, such as a benzene, naphthalene, indene, fluorene or anthracene ring.

The aromatics can, in addition to the substituents already mentioned, have further substituents such as alkyl radicals.

Furthermore, heterocyclic compounds are also suitable chemical compounds. For the purposes of the present invention, heterocyclic compounds are here rings containing one or more heteroatoms of the group N, O or S, with the heterocycle able to be, for example, a monocyclic, bicyclic or multiply condensed system. The heterocyclic compounds here have C—X bonds from the group C=N—C, C—S—C, C—NH—C, C—$NR_1$—C, C—O—C in the ring. Examples of heterocyclic compounds are pyrrole, pyridine, thiophene, indole, thionaphthene, pyrazole, benzimidazole, thiazole, triazoles and triazines.

The heterocyclic compounds can be substituted by one or more heteroatoms X and thus contain one or more bonds from the group C—F, C—Cl, C—Br, C—I, C—$NH_2$, C—$NHR_1$, C—$NR_1R_2$, C—SH, C=S, $COR_3$, $COOR_3$. If desired, the heterocyclic compounds can also be substituted by additional radicals, such as alkyl radicals. Preferred heterocyclic compounds are triazine compounds. The triazine ring is a benzene ring in which three carbon atoms are replaced by nitrogen atoms. Preferred triazine compounds here contain 1,3,5-triazine. 1,3,5-triazine is present in, for example, cyanuric acid and derivatives thereof, of which cyanuric acid triamide in particular, known under the name of melamine, has achieved great industrial importance. Polycondensation with aldehydes, in particular with formaldehyde, gives the important melamine resins which are used, for instance, for producing electrical insulators, consumer goods such as plates and cups or for coating materials, in particular wood fiber boards, on a large scale. However, 1,3,5-triazines are also present, for instance, in agricultural chemicals such as atrazine and in fire retardant compositions. Materials containing triazine compounds also include, for example, field formulations containing atrazine or fire retardant compositions which are to be destroyed. The process is preferably used for the environmentally appropriate disposal of melamine-formaldehyde resin, of agricultural chemicals containing the triazine ring or for disposal of the melamine-formaldehyde resin from a waste product containing such a resin.

Articles which contain the chemical compounds and which can be disposed of by the process of the invention are therefore, for example, plastics, agricultural chemicals, fire retardant compositions, particle boards and coated articles.

The cleavage of the C—X bonds of the abovementioned chemical compounds is carried out, according to the process of the invention, in the presence of an aluminum catalyst.

For the purposes Of the present invention, an aluminum catalyst is a catalyst containing an aluminum compound such as aluminum oxide, AlOOH, aluminosilicate or spinels as active constituent. In addition, the catalyst can also contain other metals such as silver, copper, iron, cobalt, nickel, titanium, manganese, chromium or mixtures thereof, preferably in the form of their oxides. Particular preference is here given to a catalyst consisting of aluminum oxide or containing aluminum oxide as the main component. The catalyst can here be used as such in the usual form, for example in the form of tablets, pellets, particles, spheres or rings, or be applied to an inert support such as, for instance, silicon, aluminum, aluminum silicate, ceramic oxides, alumina or alumina hydrates, or zinc oxide. Furthermore, the support can also be a monolithic support of ceramic, steel or glass onto which the aluminum catalyst is fixed. If an inert support is used, the catalyst should contain from about 0.1 to 50% by weight of catalytically active aluminum. However, preference is given to using the aluminum catalyst as such.

The optimum amount of catalyst which is decisive not for the reaction itself, but only for the reaction rate, essentially depends on the volume flow of the reaction gas and thus on the reaction arrangement. For each reaction arrangement, it can easily be determined by preliminary experiments using various ratios of amounts. Experiments have shown that a weight ratio of chemical compound: aluminum of from about 50:1 to 1:10, preferably from 20:1 to 1:5, gives good results in respect of the reaction rate. Since the catalyst remains highly active over a long period of time, smaller amounts of catalyst can also be used, with a longer contact time possibly being accepted.

To hydrolyze the chemical compound, it is necessary to use at least the theoretical amount of water which is required to cleave all the C—X bonds, with possible additional substituents having to be taken into account. In general, however, water is used in an excess of at least 10% of the stoichiometrically required amount, but normally in an even higher excess. In the case of, for example, melamine, at least 6 mol of water have to be used per mole, in the case of melem, at least 12 mol of water are required. From about 1.1 to 10 mol of water are preferably used per mole of chemical compound. The optimum amount of water can here be determined for each case by means of simple preliminary experiments.

The reaction temperatures are from 300° to 600° C. preferably from 350° to 500° C., particularly preferably from 380° to 450° C.

To carry out the process of the invention, the chemical compounds or articles containing the chemical compounds can be comminuted if desired, charged into a reaction apparatus together with the aluminum catalyst and water and heated to the reaction temperature. However, the water can also be introduced only when the reaction temperature has been reached. It is however also possible to initially charge the catalyst with or without water and, if desired, to continuously add the chemical compounds without or with water. This procedure is advantageously carried out in a fluidized-bed apparatus. Water can be introduced into the reaction apparatus in a customary manner, for instance in liquid form, by moistening the chemical compounds, by saturating the carrier gas with water or by spraying in or in gaseous form as water vapor. The chemical compound can, depending on its nature, be added in solid form, as a melt or dissolved in a suitable solvent. However, the chemical compound can also be added in gaseous foam if the sublimation temperature is within a suitable temperature range. For this purpose, the chemical compounds are preheated, whereupon the sublimation gases formed are, if desired with the aid of a carrier gas which is inert under the reaction conditions, passed at the reaction temperature over the aluminum catalyst.

On contact of the chemical compounds with the water vapor and the aluminum catalyst, the substituents are cleaved off and rings or chains containing a heteroatom X are broken up and degraded.

This gives, depending on the type of heteroatoms or C—X bonds, different degradation products. C—X bonds from the group C—F, C—Cl, C—Br and C—I are, for example, cleaved into an alcohol, which can be further degraded by dehydration, and a hydrogen halide. C—X bonds from the group C—$NH_2$, C—$NHR_1$, C—$NR_1R_2$, C—NH—C, C—$NR_1$—C, C=N—C are cleaved into $CO_2$ and $NH_3$ or $NHR_1$ or $NR_1R_2$, with the amines being able to be further cleaved by deamination.

Furthermore, additional degradation products such as, for example, dehydrogenation products of any side-chain groups and side-chain rearrangement products, such as, for example, hydrogen and acetonitrile, can occur in the process of the invention. If a chemical compound has both halogen substituents and C—N bonds, it is possible that ammonium halide, for example ammonium chloride, which is obtained as white powder in the condensation zone, is formed. Thus, in the degradation according to the invention of atrazine, viz. a triazine ring which is substituted by a chlorine atom, an ethylamino group and an iso-propylamino group, products which were detected in the reaction gases were side-chain groups such as ethylamine, deamination products of the side-chain groups such as ethylene, iso-propylene, dehydrogenation products of the side-chain groups and side-chain rearrangement products such as hydrogen and acetonitrile. In addition, there was formation of ammonium chloride which was found in the condensation zone as a white powder.

The reaction gases formed are conducted away, if desired with the aid of a carrier gas, and the ammonia and $CO_2$ contained therein are separated by conventional means, for example in accordance with AT 360.447, and are reused.

Other gases, liquids such as, for example, alcohols, or solids which can be formed in the process of the invention as degradation products are isolated in a conventional manner by prior art methods.

Suitable carrier gases are, for instance, helium, argon, nitrogen or air.

The process can be carried out continuously or batchwise and is preferably carried out continuously.

In a preferred embodiment, the chemical compounds or articles containing such compounds, if desired after comminution or melting; are mixed with an aluminum catalyst and treated with water vapor at temperatures of from 380° to 500° C. The reaction gases are conducted away with the aid of helium as carrier gas and are separated in a conventional manner. Further degradation products are likewise separated in a conventional manner and isolated.

In a particularly preferred embodiment, a fluidized bed reactor is charged with aluminum oxide together with the chemical compounds and a fluidized bed is built up by passing in an inert carrier gas; water vapor is introduced in this fluidized bed at temperatures of from 300° to 600° C. However, it is also possible to build up a fluidized bed composed of only aluminum oxide, into which fluidized bed the chemical compound is introduced in solid form or in the form of sublimation gases and water vapor, preferably continuously and if desired together with a carrier gas inert under the reaction conditions. The reaction gases are removed from the reactor in a conventional manner and separated in a conventional manner.

In the described manner, chemical compounds which contain one or more heteroatoms X are disposed of in an environmentally appropriate way. The process is therefore an advance in the art.

EXAMPLE 1

40 ml (0.49 mol) of $CHCl_3$ ($\rho$=1.47) and 40 ml (2.22 mol) of $H_2O$ were metered into a vaporizer at 200° C. over a period of 160 minutes at a metering rate of 15 ml/h. The vaporized starting materials were subsequently passed, using a $N_2$ stream (220 l/h) preheated to 200° C., into an $Al_2O_3$-fluidized-bed catalytic furnace at 370° C. The gas mixture obtained from the catalytic furnace was first passed through a water condenser, then through a cold trap cooled with liquid nitrogen and subsequently through 700 ml of a NaOH charge. The content of conc. NaOH was here accurately determined before and after the reaction and the consumption was converted into HCl content.

The condensed gas mixture from the reflux condenser and the cold trap were combined and phase separation was carried out. The HCl content of the aqueous phase Was determined by titration with 1N NaOH solution. From the HCl content of the NaOH charge and the HCl content of the aqueous phase, a conversion of 30.6% was calculated.

In a similar manner to Example 1, further experiments were carried out at the same temperature; the parameters and results are summarized in Table 1.

The following abbreviations are used:
Starting material: SM
Molar ratio: SM: $H_2O$
Total reaction time: RT

TABLE 1

| Ex. | SM | SM:$H_2O$ | SM/$H_2O$ (ml) | RT (min) | $N_2$ (l/h) | % conversion |
|---|---|---|---|---|---|---|
| 2 | $CHCl_3$ $\rho$ = 1.47 | 0.61:2.8 | 50/50 | 203 | 225 | 34.8/Cl |
| 3 | 1,2-dichloroethane $\rho$ = 1.25 | 0.63:2.8 | 50/50 | 200 | 225 | 33.1/Cl |
| 4 | benzyl chloride $\rho$ = 1.10 | 0.395:2.77 | 50/50 | 205 | 235 | 69.1/Cl |
| 5 | butyl iodide $\rho$ = 1.61 | 0.44:2.8 | 50/50 | 200 | 235 | 53.1/I |
| 6 | butyl iodide $\rho$ = 1.61 | 0.44:2.8 | 50/50 | 215 | 230 | 57.1/I |
| 7 | 1-bromoundecane $\rho$ = 1.05 | 0.22:2.77 | 50/50 | 215 | 235 | 51.5/Br |
| 8 | n-bromoundecane $\rho$ = 1.05 | 0.205:2.55 | 46/46 | 185 | 230 | 59.6/Br |
| 9 | chlorocyclohexane $\rho$ = 1.00 | 0.396:2.61 | 47/47 | 200 | 226 | 78.7/Cl |
| 10 | chlorocyclohexane $\rho$ = 1.00 | 0.42:2.77 | 50/50 | 205 | 226 | 86.1/Cl |
| 11 | dibromoethane $\rho$ = 2.18 | 0.534:2.55 | 46/46 | 188 | 226 | 42.0/Br |
| 12 | dibromoethane $\rho$ = 2.18 | 0.39:1.88 | 34/34 | 140 | 226 | 33.6/Br |
| 13 | butyl chloride $\rho$ = 0.88 | 0.475:2.77 | 50/50 | 210 | 240 | 63.7/Cl |
| 14 | chlorobenzene $\rho$ = 1.104 | 0.49:2.77 | 50/50 | 220 | 235* | 20.0/Cl |

*air was used in place of $N_2$

As a comparative experiment, an experiment was carried out in a similar manner to Example 1 using 47 ml (0.58 mol) of $CHCl_3$ without use of water vapor, a conversion of only 6.48% being achieved.

EXAMPLE 15

A fluidized-bed reactor was charged with 100 g of melamine (0.8 mol). A fluidized bed was built up by means of nitrogen and was heated to 380° C., subliming the melamine. The sublimation gases were, together with 22 g of water (1.2 mol), passed at 320° C. over a catalyst bed of aluminum oxide over a period of 2 hours with the aid of a nitrogen gas stream.

The composition of the reaction gases was determined by mass spectrometry, with only ammonia, $CO_2$ and nitrogen being found.

The main amount of the reaction gases was passed into water, with no melamine being found in the solution.

EXAMPLE 16

This was carried out in the same way as Example 15, but using 130 g of water (7.2 mol) and a reaction temperature of 380° C., with the same results as described in Example 1 being obtained.

EXAMPLE 17

10 mg of melamine-formaldehyde resin having a weight ratio of melamine:formaldehyde equal to 1:1.7 were mixed with 100 mg of $Al_2O_3$ and heated in a water-saturated helium gas stream to 400° C. The reaction gases were analyzed by mass spectrometry, with only ammonia, $CO_2$ and water being found.

EXAMPLE 18

A heatable reaction tube, which was divided into two chambers by means of glass wool, was charged with 1 mg of melem in chamber 1 and 20 mg of aluminum oxide in chamber 2. The tube was heated to 400° C., with a water-saturated helium gas stream being passed through. Analysis of the reaction gases showed that only ammonia and $CO_2$ occurred as reaction products.

EXAMPLE 19

A heatable reaction tube having a diameter of 4 mm was charged with 50 mg of atrazine and, at a distance of from 80 to 100 mm, 50 mg of aluminum oxide. The tube was heated to 450° C. and supplied with a stream of helium and water vapor (30 ml per minute, partial pressure of water vapor=32 mbar). The atrazine sublimed and the sublimation gases were conducted into the catalyst zone by means of the gas stream. The hydrolysis was complete after one hour.

The reaction gas was analyzed by mass spectrometry, with ammonia, $CO_2$, ethylamine, ethylene, isopropylene and small amounts of hydrogen being found. In the colder zone of the reaction tube there were found 12 mg of a white powder which was identified as ammonium chloride.

EXAMPLE 20

This was carried out in the same way as Example 19, with the reaction temperature being 500° C. instead of 450° C. The reaction gas was found to contain ammonia, $CO_2$, ethylene, isopropylene, acetonitrile and higher amounts of hydrogen than found in Example 5. In the colder zone of the reaction tube there were found 12 mg of a white powder which was identified as ammonium chloride.

EXAMPLE 21

A heatable reaction tube having a diameter of 4 mm was charged with 100 mg of $Al_2O_3$. The tube was heated to 400° C. and supplied with a helium stream (30 ml/min) saturated with water and diethylamine.

After hydrolysis was complete, the reaction gas was analyzed by mass spectrometry, with ammonia, acetonitrile and traces of HCN being found.

EXAMPLE 22

This was carried out in a similar manner to Example 21, the reaction temperature being 480° C. Ammonia, hydrogen, ethylene and traces of HCN were found in the reaction gas.

EXAMPLE 23

As a comparative experiment, diethylamine was decomposed without water in a similar manner to Example 21 and 22, with no reaction occurring at 400° C. and, at 480° C., the amounts of acetonitrile, HCN and hydrogen being very large and only a small amount of ammonia being found.

EXAMPLE 24

Dimethylamine was hydrolyzed in a similar manner to Example 21. After hydrolysis was complete at a reaction temperature of 400° C., methylamine, trimethylamine, CO and traces of HCN and acetonitrile were found in the reaction gas. The conversion was 14%. At a reaction temperature of 460° C., the reaction gas was, after hydrolysis was complete, found to contain ammonia, methylamine, trimethylamine, CO and traces of ethylenediamine and acetonitrile. The conversion was 42%.

At a reaction temperature of 520° C., the amount of ammonia in the reaction gas increased strongly, the conversion being 84%.

What we claim is:

1. Process for the degradation of atrazine or melamine-formaldehyde resins having C—X bonds where X is N, or compounds which have one or more C—X bonds, where X is selected from the group consisting of F, Cl, Br, I, O and S, by cleavage of the C—X bonds, wherein said atrazine or melamine-formaldehyde resins or compounds or articles which contain said atrazine or melamine-formaldehyde resins or compounds are treated with water vapor at a temperature of 300° to 600° C. in the presence of an aluminum catalyst consisting essentially of catalytically active aluminum oxide or AlOOH as active constituent.

2. Process according to claim 1, wherein the compounds contain one or more C—X bonds which are C—F, C—Cl, C—Br, C—I, C—SH, C—S—C, C—S—S—C, C=S, C—O—C, C—OR, $COOR_3$ or C=O, where R is H or alkyl.

3. Process according to claim 1, wherein the compounds are aliphatic hydrocarbons substituted by one or more radicals selected from the group consisting of —F, —Cl, —Br, —I, —OR, —$OOR_3$, =O and —SH, and optionally, in addition to the above C—X bonds, contain C—X bonds selected from the group consisting of C—S—C, C—S—S—C, and C—O—C, in the hydrocarbon chain, where $R_3$ is H or alkyl.

4. Process according to claim 1, wherein the compounds are aromatic hydrocarbons substituted by one or more radicals selected from the group consisting of —F, —Cl, —Br, —I, —$OR_3$, and —SH, where $R_3$ is H or alkyl.

5. Process according to claim 1, wherein the compounds are heterocyclics which contain one or more C—X bonds which are C—S—C or C—O—C in the ring and are unsubstituted or substituted by one or more radicals which are —F, —Cl, —Br, —I, —$OR_3$, or —SH, where $R_3$ is H or alkyl.

6. Process according to claim 1, wherein atrazine or melamine-formaldehyde resins are decomposed.

7. Process according to claim 1, wherein the catalyst used is aluminum oxide.

8. Process according to claim 1, wherein the aluminum catalyst is initially charged in a fluidized-bed apparatus and a carrier gas inert under the reaction conditions is used to build up a fluidized bed into which the water vapor and the chemical compound are introduced, whereupon the reaction gases and other degradation products are conducted away and separated.

9. Process according to claim 1 which consists essentially of subjecting said compounds to water vapor in the presence of an aluminum catalyst.

10. Process according to claim 9, wherein the catalyst consists essentially of aluminum oxide.

11. Process according to claim 9, wherein X is Cl, Br, I, O or S.

12. Process according to claim 9, wherein X is F, Br, I, O or S.

13. Process according to claim 9, wherein X is F, Cl, Br, I, O or S.

14. Process according to claim 1, wherein the catalyst is in the form of tablets, pellets, particles, spheres or rings.

15. Process according to claim 1, wherein the catalyst is applied to a support which is inert under reaction conditions and comprises silicon, aluminum, zinc oxide or steel.

16. The process according to claim 1, wherein the compound having a C—X bond is trichloromethane, methylene chloride, dichloroethane, dibromoethane, butyl iodide, dimethylmethane, butyl chloride, chlorocyclohexane, bromoundecane, benzyl chloride or chlorobenzene.

* * * * *